US005555744A

United States Patent [19]

Hirano

[11] Patent Number: 5,555,744

[45] Date of Patent: Sep. 17, 1996

[54] REFRIGERANT CIRCUIT FOR ICE MAKING MACHINES ETC.

[75] Inventor: Akihiko Hirano, Toyoake, Japan

[73] Assignee: Hoshizaki Denki Kabushiki Kaisha, Aichi, Japan

[21] Appl. No.: 386,682

[22] Filed: Feb. 10, 1995

[30] 30

[30] Foreign Application Priority Data

Feb. 10, 1994 [JP] Japan ..... 6-037655
Jan. 23, 1995 [JP] Japan ..... 7-027507

[51] Int. Cl.[6] ..... F25C 5/10

[52] U.S. Cl. ..... 62/352; 62/196.4; 62/278

[58] Field of Search ..... 62/156, 278, 352, 62/196.4, 81

[56] References Cited

U.S. PATENT DOCUMENTS 4,565,070 1/1986 Raymond ..... 62/278 X
4,791,792 12/1988 Naruse et al. ..... 62/352 X
5,203,176 4/1993 De Weered ..... 62/352 X

*Primary Examiner*—William E. Tapolcai
*Attorney, Agent, or Firm*—Koda and Androlia

[57] ABSTRACT

Disclosed is a refrigerant circuit for an ice making machine and the like, in which not only drop in the performance or damage of a compressor due to the abnormally elevated higher level pressure thereof but also double-freezing can effectively be prevented. The refrigerant circuit comprises a freezing circuit in which a vaporized refrigerant compressed in a compressor to high temperature and pressure levels is fed via a solenoid valve to a condenser, the refrigerant condensed in the condenser is then fed to an expansion means, the refrigerant vaporized through the expansion means is further fed to an evaporator, and the vaporized refrigerant heated through heat exchange with the evaporator is fed back to the compressor; and a hot gas circuit which bypasses the high-pressure and high-temperature vaporized refrigerant fed from the compressor to the evaporator via a hot gas valve so as to achieve ice releasing and the like at the evaporator; the solenoid valve and the hot gas valve being designed to be let open and closed, respectively, during the freezing operation and to be closed and let open, respectively, when the operation mode is switched to the ice releasing operation; wherein the solenoid valve is designed to be let open before completion of the ice releasing operation.

8 Claims, 10 Drawing Sheets

REFRIGERANT CIRCUIT FOR ICE MAKING MACHINES ETC.

BACKGROUND OF THE INVENTION

This invention relates to a refrigerant circuit, in an ice making machine and the like in which ice pieces formed on ice making plates and the like are released therefrom by allowing a high-temperature and high-pressure vaporized refrigerant from a compressor to flow into an evaporator, which enables secured and stable releasing of the ice pieces even when the ambient temperature is low.

An ice making machine for making automatically a number of ice pieces has a freezing circuit for circulating a refrigerant, in which the ice making plates are designed to be heated by feeding a high-pressure and high-temperature vaporized refrigerant (hereinafter sometimes referred to as hot gas) from a compressor to the evaporator attached to the ice making plates, upon switching from a freezing operation to an ice releasing operation, to accelerate releasing of the ice pieces formed on the ice making plates. For example, FIG. 11 shows a flow-down system ice making machine, in which water to be frozen is sprinkled against ice making plates standing perpendicularly to form ice pieces continuously thereon. In this type of ice making machine, an evaporator 14 led out of a freezing circuit 12, shown in FIG. 12, running zigzag in the transverse direction is secured in closed contact between a couple of ice making plates 10 disposed perpendicularly, and a refrigerant is circulated through the evaporator 14 during the freezing operation to forcibly cool these ice making plates 10. A plurality of vertical elongated ridges 10*a* are arranged on the freezing surface of each ice making plate 10 in the transversal direction, and ice pieces 16 are designed to be formed between every two adjacent ridges 10*a* at the positions where the evaporator 14 runs. A slanted water collecting plate 18 having a plurality of through holes 18*a* is disposed immediately below the ice making plates 10, and the portion of the water to be frozen which was fed to the ice making plates 10 during the freezing operation but failed to freeze is dripped through the through holes 18*a* to be recovered and stored in a water tank 20 locating below the water collecting plate 18. Incidentally, the water collecting plate 18 also serves to guide the ice pieces 16 released from the ice making plates 10 under the ice releasing operation and dropped to the plate 18 into an ice bin 22 disposed diagonally below the water collecting plate 18.

A water supply pipe 26 led out of the water tank 20 through a circulating pump 54 is connected to a sprinkler 28 disposed above the ice making plates 10 and on the freezing surface sides thereof. A plurality of water distribution holes (not shown) are formed in this sprinkler 28, and the water to be frozen pumped up from the tank 20 during the freezing operation is designed to be sprinkled through these water distribution holes onto the freezing surfaces of the ice making plates 10 cooled to the freezing point and to flow down therealong, whereby to form ice pieces 16 having a predetermined shape on the freezing surfaces.

FIG. 12 shows schematically a constitution of the freezing circuit to be suitably employed in the above-described automatic ice making machine. The freezing circuit 12 essentially has a compressor 30 for compressing a refrigerant such as Freon, a condenser 32 to which the high-pressure and high-temperature vaporized refrigerant obtained after compression in the compressor 30 is fed, an expansion valve 34 to which the refrigerant condensed to be liquefied in the condenser 32 is fed and an evaporator 14 to which the refrigerant expanded to be vaporized through the expansion valve 34 is fed. The evaporator 14 performs heat exchange with the refrigerant expanded and vaporized through the expansion valve 34 so as to cool the ice making plates 10 attached to the evaporator 14 below the freezing point and allow the water to be frozen flowing down along the ice making plates 10 to freeze gradually. The vaporized refrigerant heated after heat exchange in the evaporator 14 is fed back to the compressor 30, compressed to a high pressure and a high temperature and then recirculated. Incidentally, the reference number 36 denotes a detecting means for detecting the temperature of the refrigerant on the refrigerant outlet side of the evaporator 14, and the detecting means 36 is designed to perform aperture control of the expansion valve 34.

A pipe 38 branching out of a pipe 37 locating on the outlet side of the compressor 30 is connected via a hot gas valve 40 such as a solenoid valve to the inlet side of the evaporator 14 to constitute a so-called hot gas circuit 42. The hot gas valve 40 is closed during the freezing operation to interrupt circulation of the refrigerant through the hot gas circuit 42 and to circulate the refrigerant to the freezing circuit 12 only. Meanwhile, when the ice releasing operation for releasing and dropping the ice pieces is started after completion of the freezing operation at the ice making plates 10, the hot gas valve 40 is let open to allow a hot refrigerant (hot gas) to circulate through the hot gas circuit 42. Thus, the ice making plates 10 attached to the evaporator 14 are heated to release adhesion of the ice pieces 16 formed on these ice making plates 10 and allows them to drop by their own weights.

As described above, when the operation mode of the ice making machine is switched to the ice releasing operation, the hot gas valve 40 is changed over from the closed posture to the open posture (1) to interrupt circulation of the refrigerant through the freezing circuit 12 and (2) to feed the high-pressure and high-temperature vaporized refrigerant from the outlet side of the compressor 30 to the evaporator 14. However, as shown in FIG. 12, no closing means such as a valve is disposed on the inlet side of the condenser 32. Accordingly, the hot gas delivered from the compressor 30 during the ice releasing operation is not entirely fed to the hot gas circuit 42, but the substantial portion of the hot gas is designed to be circulated through the hot gas circuit 42. The small portion of the hot gas flows into the condenser 32 where the heat is dissipated well, and the hot gas is liquefied and stays therein (this phenomenon is termed as "stagnation"). If some portion of the hot gas stagnates in the freezing circuit 12 connected to the condenser 32, the hot gas to be circulated through the hot gas circuit 42 decreases with time corresponding to the amount of stagnation. It can thus be pointed out that the ice releasing performance in the evaporator 14 is gradually lowered to require a considerable time for the ice releasing operation, disadvantageously. Such problem occurs conspicuously, particularly when the ambient temperature is low. Incidentally, in the freezing circuit of a system in which a receiver is provided on the outlet side of the condenser 32, the amount of stagnated hot gas is increased, so that the ice releasing performance is further lowered.

A countermeasure for such problem is proposed, in which a solenoid valve 44 is disposed, as shown in FIG. 13, on the downstream side (on the condenser (32) side), with respect to the flow of the refrigerant, than the junction of the pipe 38 with the pipe 37 connecting the compressor 30 to the condenser 32. Namely, during the freezing operation, the solenoid valve 44 is let open to allow the refrigerant to circulate through the freezing circuit 12, and also the hot gas valve 40 is closed to interrupt circulation of the refrigerant through the hot gas circuit 42. Meanwhile, when the operation mode is switched from the freezing operation to the ice releasing operation, the solenoid valve 44 is closed to interrupt circulation of the refrigerant through the freezing circuit 12, and also the hot gas valve 40 is let open to allow the heated refrigerant (hot gas) to circulate through the hot gas circuit 42. Thus, the hot gas delivered from the compressor 30 during the ice releasing operation is entirely fed to the hot gas circuit 42 so as to prevent drop in the ice releasing performance, enabling reduction of the time required for the ice releasing operation.

It should be noted here that when the ambient temperature is low like in winter, the ice releasing performance frequently becomes insufficient, as described above, but when the ambient temperature is high like in summer, very high ice releasing performance is not required. Accordingly, if the solenoid valve 44 is closed regardless of the ambient temperature, when the operation mode is switched from the freezing operation to the ice releasing operation, a large amount of hot gas flows through the hot gas circuit 42 particularly under the condition where the ambient temperature is high (high temperature, e.g. 20° C. or higher). Then, the ice making plates 10 are heated very much to increase the recycling freezing time or to excessively increase the pressure on the refrigerant inlet side of the compressor 30 (lower level pressure) and apply a great load to the compressor 30, leading to liability to drop in the ice making performance or breakdown of the compressor 30.

In the ice making-machine described above, a thermostat is disposed correspondingly on the outlet side of the evaporator 14 provided between the ice making plates 10, so that the temperature rise in the evaporator 14 due to the increased amount of the hot gas flowing without undergoing heat exchange after releasing of the ice pieces 16 from the ice making plates 10 may be detected by the thermostat to complete the ice releasing operation. In this case, in the state where the solenoid valve 44 is let open so as to start the ice releasing operation and the hot gas is entirely circulated through the evaporator 14 even if almost all of the ice pieces 16 are released from the ice making plates 10 to apply reduced load thereto near the end of the ice releasing operation, substantially the same amount of hot gas is circulated as in the case where a great load is applied to the ice making plates, so that the temperature of the evaporator 14 is occasionally elevated speedily to allow the thermostat to detect completion of the ice releasing. In other words, although some ice pieces 16 still remain on the ice making plate 10, the freezing operation is resumed, leading to double-freezing, disadvantageously. Such trouble occurs particularly when the ambient temperature is extremely low (very low temperature, e.g. 0° C. or lower).

SUMMARY OF THE INVENTION

This invention is proposed in order to overcome the above problems inherent in the prior art refrigerant circuit for ice making machines and the like and overcome them suitably, and it is an objective of this invention to provide a means which can constantly achieve ice releasing efficiently regardless of the ambient temperature and which can effectively prevent double-freezing at a low temperature.

With a view to overcoming the problem described above and attaining the intended object suitably, the refrigerant circuit for ice making machines and the like according to this invention comprises a freezing circuit in which a high-pressure and high-temperature vaporized refrigerant obtained after compression in a compressor is fed via a solenoid valve to a condenser, the refrigerant condensed to be liquefied in said condenser is then fed to an expansion means, the refrigerant expanded to be vaporized through said expansion means is further fed to an evaporator, and the vaporized refrigerant heated through heat exchange with said evaporator is fed back to said compressor; and a hot gas circuit which bypasses said high-pressure and high-temperature vaporized refrigerant fed from said compressor to said evaporator via a hot gas valve so as to achieve ice releasing and the like at said evaporator; said solenoid valve and said hot gas valve being designed to be let open and closed, respectively, during the freezing operation; wherein said hot gas valve is designed to be let open with said solenoid valve still assuming an open posture, when the operation mode is switched to the ice releasing operation under the condition where the ambient temperature is higher than a predetermined level; and said hot gas valve and said solenoid valve are designed to be let open and closed, respectively, when the operation mode is switched to the ice releasing operation under the condition where the ambient temperature is lower than the predetermined level.

In order to suitably attain the intended object described above, the refrigerant circuit for an ice making machines and the like according to another aspect of the invention comprises a freezing circuit in which a high-pressure and high-temperature vaporized refrigerant obtained after compression in a compressor is fed via a solenoid valve to a condenser, the refrigerant condensed to be liquefied in said condenser is then fed to an expansion means, the refrigerant expanded to be vaporized through said expansion means is further fed to an evaporator, and the vaporized refrigerant heated through heat exchange with said evaporator is fed back to said compressor; and a hot gas circuit which bypasses said high-pressure and high-temperature vaporized refrigerant fed from said compressor to said evaporator via a hot gas valve so as to achieve ice releasing and the like at said evaporator; said solenoid valve and said hot gas valve being designed to be let open and closed, respectively, during the freezing operation and to be closed and let open, respectively, when the operation mode is switched to the ice releasing operation; wherein said solenoid valve is designed to be let open before completion of the ice releasing operation.

In order to suitably attain the intended object described above, the refrigerant circuit for an ice making machines and the like according to another aspect of the invention comprises a freezing circuit in which a high-pressure and high-temperature vaporized refrigerant obtained after compression in a compressor is fed via a solenoid valve to a condenser, the refrigerant condensed to be liquefied in said condenser is then fed to an expansion means, the refrigerant expanded to be vaporized through said expansion means is further fed to an evaporator, and the vaporized refrigerant heated through heat exchange with said evaporator is fed back to said compressor; and a hot gas circuit which bypasses said high-pressure and high-temperature vaporized refrigerant fed from said compressor to said evaporator via a hot gas valve so as to achieve ice releasing and the like at said evaporator; said solenoid valve and said hot gas valve being designed to be let open and closed, respectively, during the freezing operation, and to be closed and let open, respectively, when the operation mode is switched to the ice releasing operation; wherein said solenoid valve is closed with a predetermined time lag after said hot gas valve is let open, when the freezing operation is switched to the ice releasing operation.

In order to suitably attain the intended object described above, the refrigerant circuit for an ice making machines and the like according to another aspect of the invention comprises a freezing circuit in which a high-pressure and high-temperature vaporized refrigerant obtained after compression in a compressor is fed via a solenoid valve to a condenser, the refrigerant condensed to be liquefied in said condenser is then fed to an expansion means, the refrigerant expanded to be vaporized through said expansion means is further fed to an evaporator, and the vaporized refrigerant heated through heat exchange with said evaporator is fed back to said compressor; and a hot gas circuit which bypasses said high-pressure and high-temperature vaporized refrigerant fed from said compressor to said evaporator via a hot gas valve so as to achieve ice releasing and the like at said evaporator; wherein said hot gas valve is designed to be let open with said solenoid valve still assuming an open posture, when the operation mode is switched to the ice releasing operation under the condition where the ambient temperature is higher than a predetermined level; said hot gas valve and said solenoid valve are designed to be let open and closed, respectively, when the operation mode is switched to the ice releasing operation under the state where the ambient temperature is lower than the predetermined level; and said solenoid valve, which is closed when the operation mode is switched to the ice releasing operation, is designed to be let open, in the case where the ambient temperature is extremely lower than the predetermined temperature level, at the time point where a temperature sensing means, disposed adjacent to the refrigerant outlet side of said evaporator, detects that the refrigerant temperature on the refrigerant outlet side of said evaporator is reaching a predetermined level. In order to suitably attain the intended object described above, the refrigerant circuit for an ice making machines and the like according to another aspect of the invention comprises a freezing circuit in which a high-pressure and high-temperature vaporized refrigerant obtained after compression in a compressor is fed via a solenoid valve to a condenser, the refrigerant condensed to be liquefied in said condenser is then fed to an expansion means, the refrigerant expanded to be vaporized through said expansion means is further fed to an evaporator, and the vaporized refrigerant heated through heat exchange with said evaporator is fed back to said compressor; and a hot gas circuit which bypasses said high-pressure and high-temperature vaporized refrigerant fed from said compressor to said evaporator via a hot gas valve so as to achieve ice releasing and the like at said evaporator, wherein said hot gas valve is designed to be let open with said solenoid valve still assuming an open posture, when the operation mode is switched to the ice releasing operation under the condition where the ambient temperature is higher than a predetermined level; said hot gas valve and said solenoid valve are designed to be let open and closed, respectively, when the operation mode is switched to the ice releasing operation under the state where the ambient temperature is lower than the predetermined level; and said solenoid valve, which is closed when the operation mode is switched to the ice releasing operation, is designed to be let open at the time point where a tamer, which starts counting when the operation mode is switched to the ice releasing operation, detects a preset time period.

DETAILED DESCRIPTION OF THE INVENTION

Figure 11:
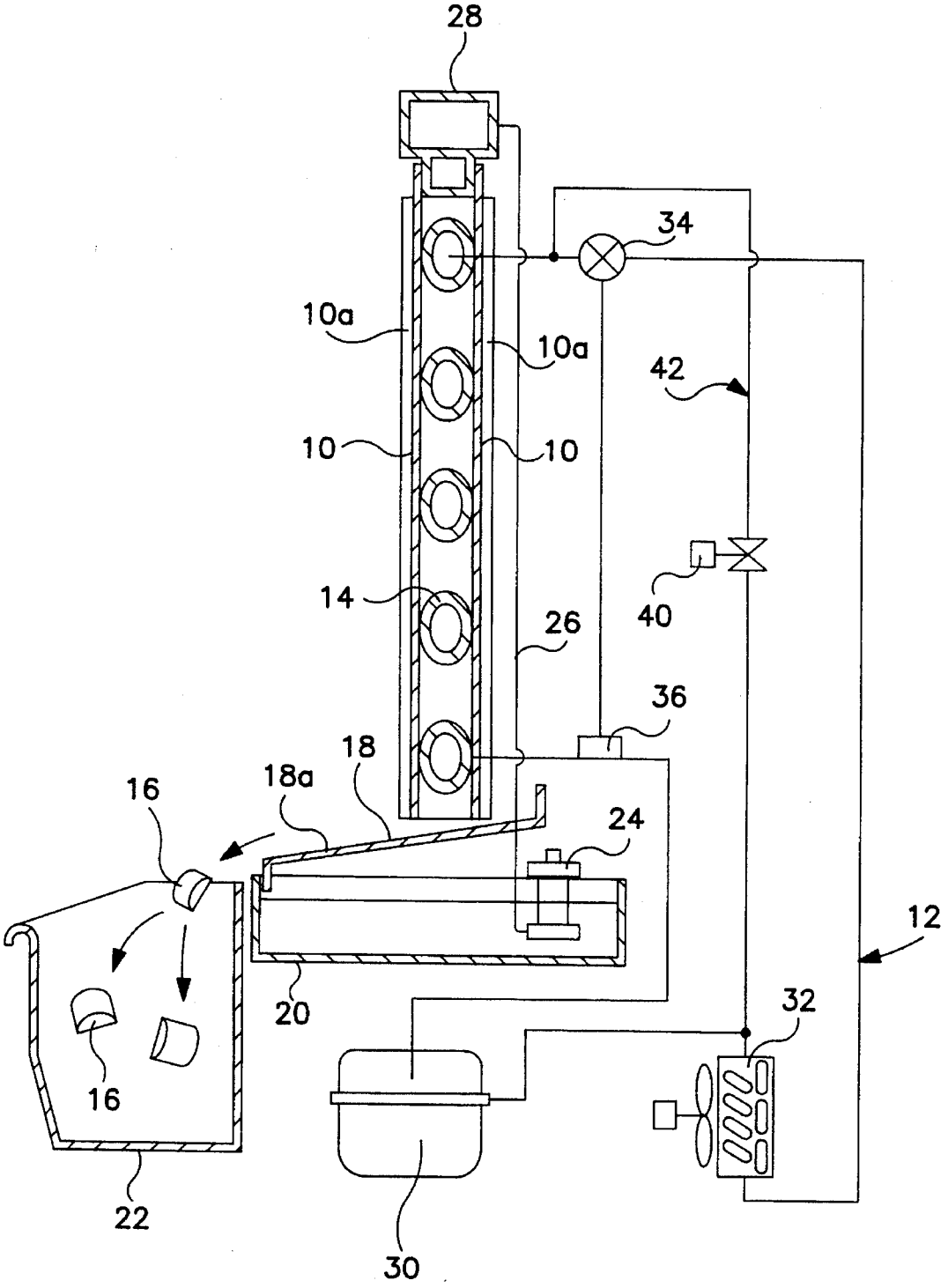
FIG. 11 shows schematically a constitution of the flow-down system automatic ice making machine in which ice pieces are formed by sprinkling water to be frozen to the ice making plates standing perpendicularly.
Figure 12:
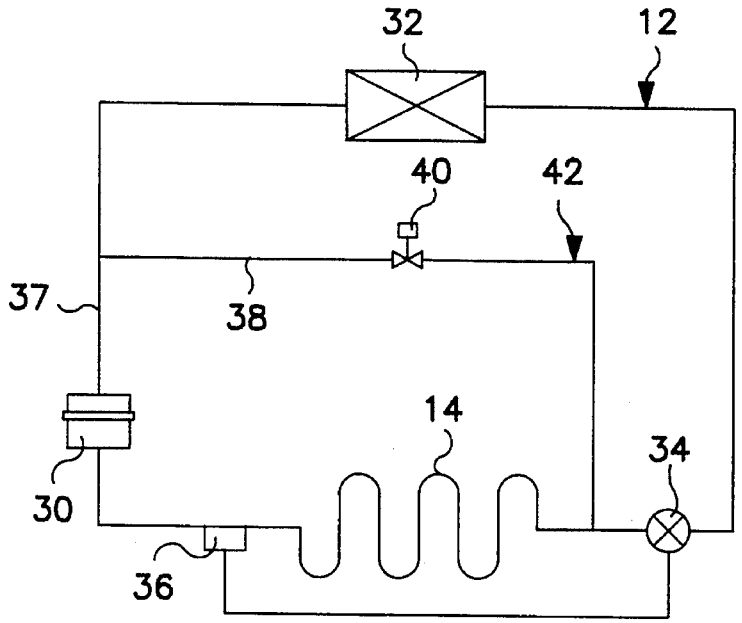
FIG. 12 PRIOR ART
FIG. 12 shows schematically a constitution of the prior art freezing circuit suitably employed in the automatic ice making machine shown in FIG. 11.

The refrigerant circuit for ice making machines and the like according to this invention will be described below by way of preferred embodiments referring to the attached drawings. It should be appreciated that the members similar to those already described with respect to the freezing circuit and the hot gas circuit referring to FIG. 13 shall be denoted with the same reference numbers, respectively, and detailed description thereof will be omitted. While FIG. 1 shows a refrigerant circuit according to a first preferred embodiment of the invention, which can be employed in the flow-down system ice making machine described referring to FIG. 11, this circuit can also be employed generally in the freezers where defrosting is achieved by evaporators with the aid of hot gas.

First Embodiment

Figure 1:
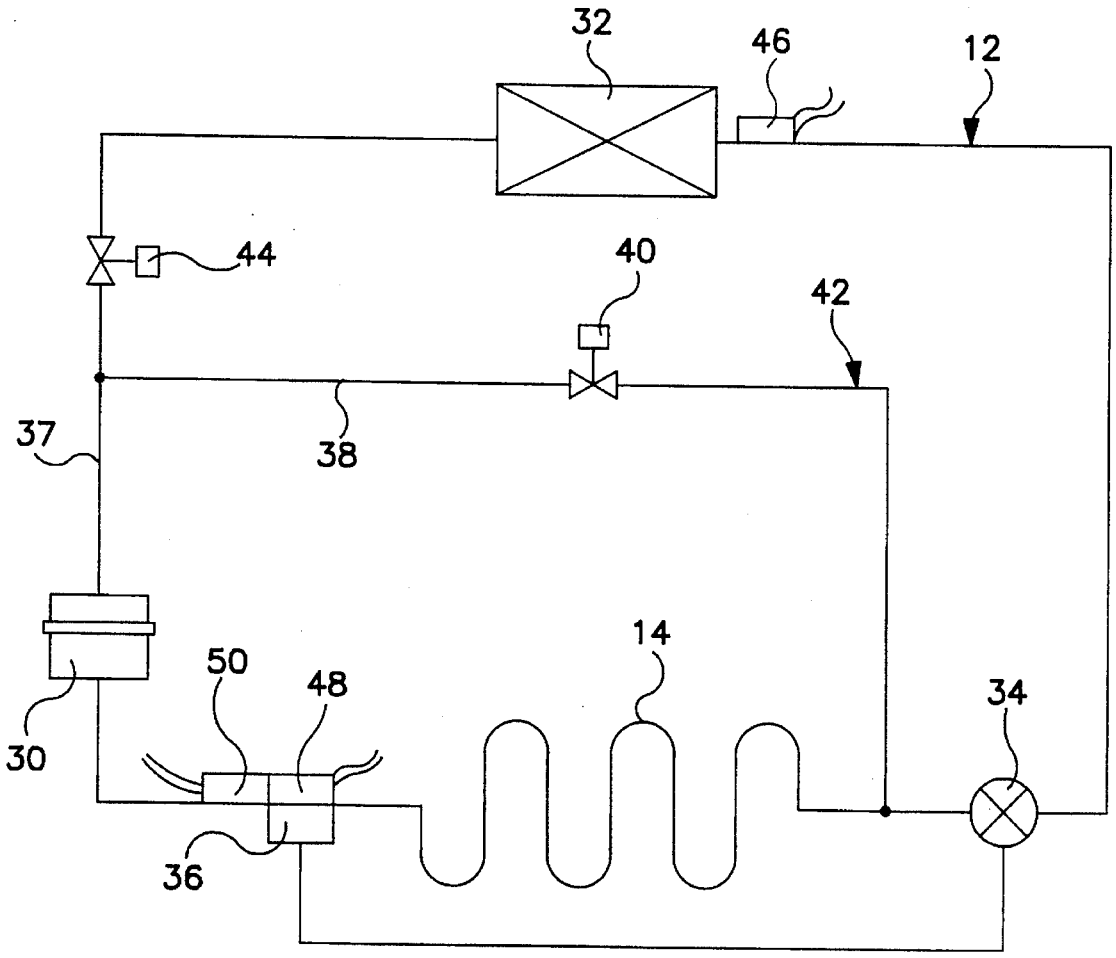
FIG. 1 shows schematically a constitution of the refrigerant circuit according to a preferred first embodiment of the invention.
Figure 13:
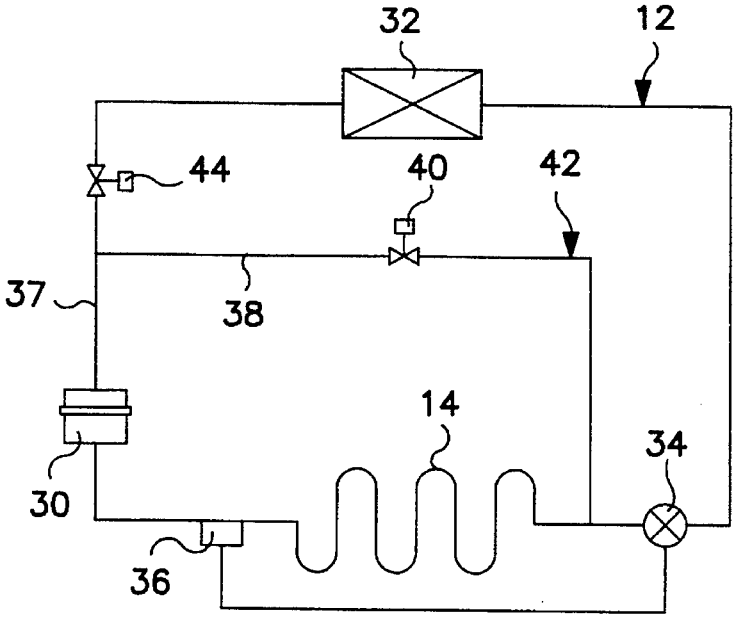
FIG. 13 PRIOR ART
FIG. 13 shows schematically a constitution of the prior art freezing circuit according to another embodiment.

The refrigerant circuit according to the first embodiment shown in FIG. 1 is basically substantially the same as that described referring to FIG. 13, and the differences are that a first temperature sensor 46 is provided on the refrigerant outlet side of the condenser 32 and that a second temperature sensor 48 is provided on the refrigerant outlet side of the evaporator 14. The first temperature sensor 46 detects the temperature of the refrigerant condensed by the condenser 32 which changes depending on the change in the ambient temperature and functions to perform open/close control of the solenoid valve other words, stagnation of the hot gas in the refrigerant circuit 12 is obviated by performing open/close control of the solenoid valve 44 based on the temperature level detected by the first temperature sensor 46, and also ice releasing can be achieved efficiently regardless of the level of the ambient temperature. Incidentally, the second temperature sensor 48 may be disposed on the ice making plate and the like, if it can detect the temperature of the refrigerant delivered from the evaporator 14.

The open/close control of the solenoid valve 44 is designed to be performed in accordance with any of the following three patterns depending on the temperature level detected by the first temperature sensor 46.

Figure 2:
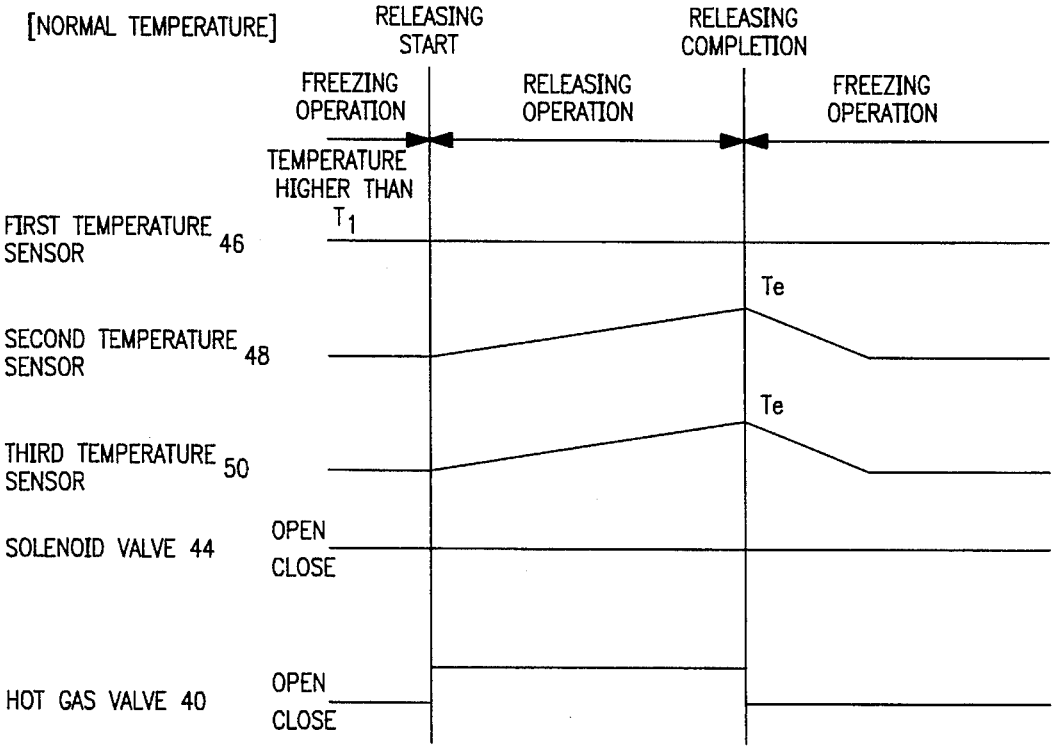
FIG. 2 is a chart showing the open/close timing of the solenoid valve and that of the hot gas valve in the refrigerant circuit according to the first embodiment at normal temperature.
Figure 3:
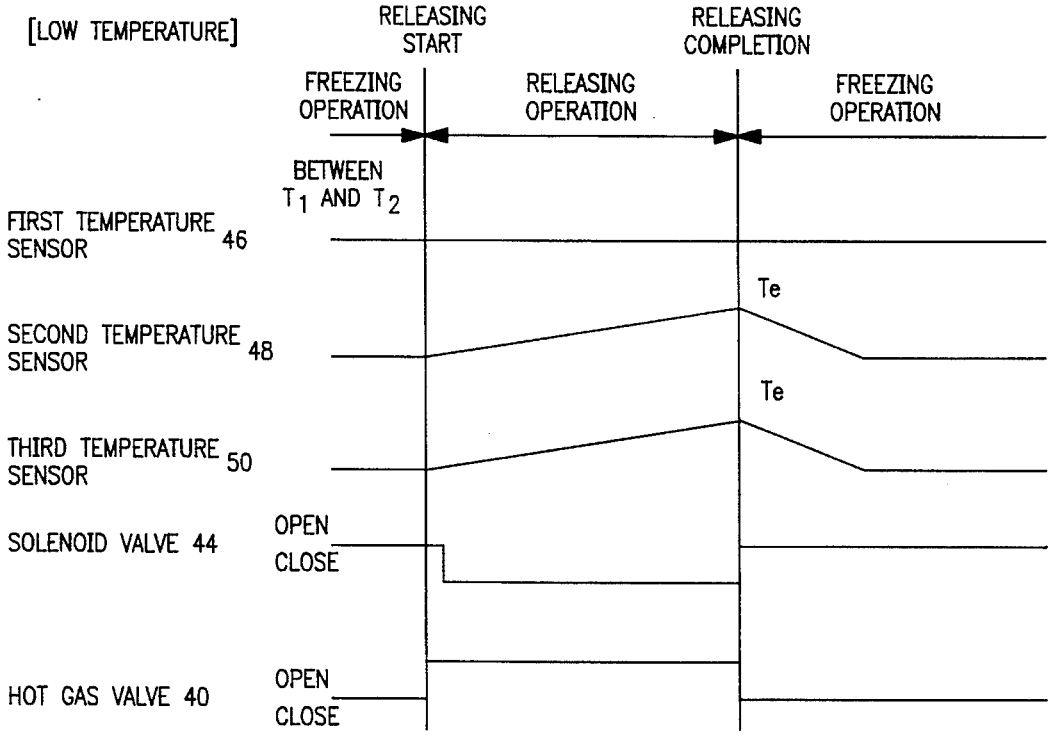
FIG. 3 is a chart showing the open/close timing of the solenoid valve and that of the hot gas valve in the refrigerant circuit according to the first embodiment at a low temperature.
Figure 4:
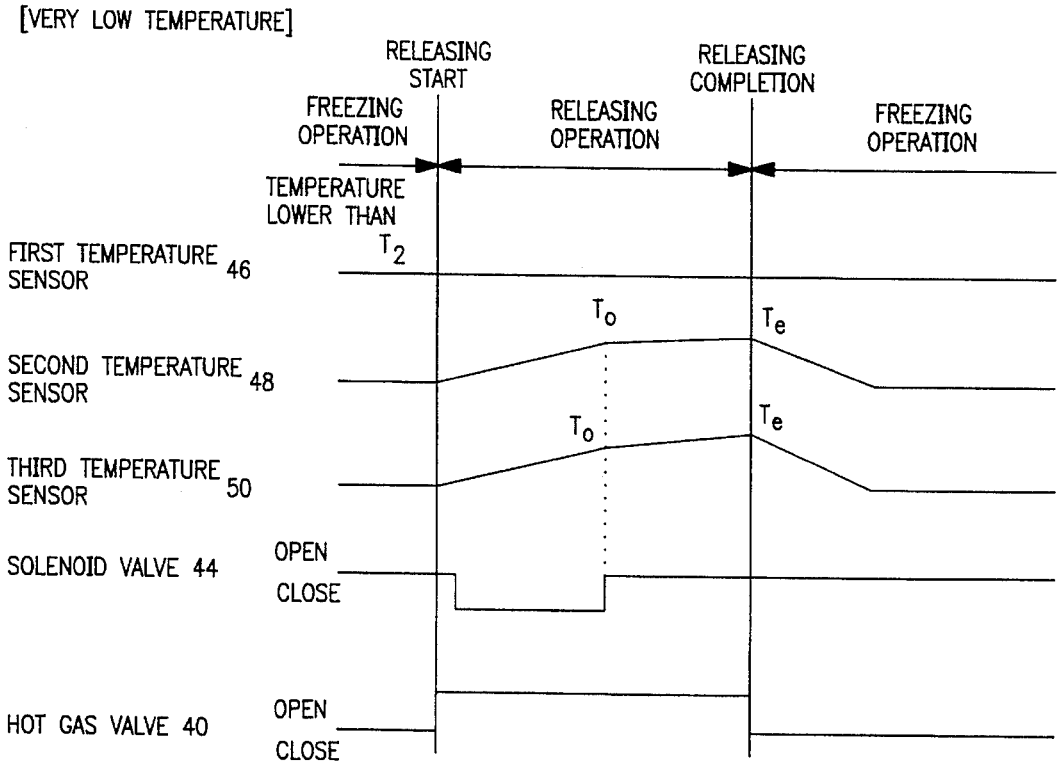
FIG. 4 is a chart showing the open/close timing of the solenoid valve and that of the hot gas valve in the refrigerant circuit according to the first embodiment at a very low temperature.

(1) In the case where the first temperature sensor 46 is detecting a temperature (normal temperature) higher than a preset first temperature $T_1$, the solenoid valve 44 is controlled to stay open when the freezing operation is be switched to the ice releasing operation (see FIG. 2);

(2) In the case where the first temperature sensor 46 is detecting a temperature (low temperature) between the first temperature $T_1$ and a second temperature $T_2$ which is lower than the temperature $T_1$ ($T_1>T_2$), the solenoid valve 44 is controlled to be closed when the freezing operation is to be switched to ice releasing operation (see FIG. 3); and (3) in the case where the first temperature sensor 46 is detecting a temperature (very low temperature) lower than the second temperature $T_2$, the solenoid valve 44 is designed to be controlled to be closed once when the freezing operation is to be switched to the ice releasing operation, and then to be let open at an appropriate time before completion of the ice releasing operation (see FIG. 4).

It should be noted that, when the control (2) or (3) is to be carried out in the first embodiment, a timer (not shown) is utilized to close the solenoid valve 44 with a predetermined time lag after the hot gas valve 40 is let open, as shown in FIGS. 3 and 4, so that the refrigerant already stagnated in the condenser 32 may be circulated through the hot gas circuit 42. Further, this delay in closing the solenoid valve 44 can prevent a large amount of hot gas from flowing at once into the hot gas circuit 42 to apply a great pressure to the circuit 42. While the first temperature $T_1$ and the second temperature $T_2$ change depending on the environment in which the ice making machine is to be installed, the first temperature $T_1$ and the second temperature $T_2$ are set, for example, to a temperature level corresponding to an ambient temperature of 20° C. and a temperature level corresponding to an ambient temperature of 0° C. respectively.

The second temperature sensor 48 disposed on the refrigerant outlet side of the evaporator 14 detects the refrigerant temperature on the refrigerant outlet side of the evaporator 14 and functions to control the timing of opening the solenoid valve 44 when the control at a very low temperature is to be implemented according to the control pattern (3). Namely, the second temperature sensor 48 is designed to open the solenoid valve 44 assuming a closed posture as described above, when the second temperature sensor 48 detects, under the state where the first temperature sensor 46 is detecting a temperature lower than the second temperature $T_2$, upon switching to the ice releasing operation, an open temperature To (Te>To) which is lower than an ice releasing completion temperature Te to be detected by a third temperature sensor 50 for detecting completion of ice releasing disposed on the refrigerant outlet side of the evaporator 14. As described above, the temperature status of the refrigerant is adapted to be able be constantly grasped by detecting the refrigerant temperature by the second temperature sensor 48. Incidentally, the open temperature To to be preset is decided after experiments etc.

Function of the First Embodiment

Next, the function of the refrigerant circuit according to the first embodiment will be described depending on three cases: (1) where the ambient temperature is normal temperature; (2) where the ambient temperature is low; and (3) where the ambient temperature is very low, referring to the corresponding timing charts shown in FIGS. 2 to 4, respectively.

(1) In the Case Where the Ambient Temperature is Normal Temperature

If the first temperature sensor 46 is detecting a temperature (normal temperature) higher than the first temperature $T_1$ when the operation mode in the ice making machine is to be switched from the freezing operation to the ice releasing operation, the hot gas valve 40 is let open, with the solenoid valve 44 remaining stall open, as shown in FIG. 2, to allow the hot gas to circulate through the hot gas circuit 42. Thus, the ice making plates 10 attached to the evaporator 14 are heated to release adhesion of the ice pieces 16 formed on the ice making plates 10 and allow them to drop by their own weights. When the ambient temperature is high (normal temperature), not very high ice releasing performance is required, so that the ice releasing can efficiently be achieved even if the hot gas delivered from the compressor 30 partly flows into the condenser 32. In addition, since inconveniences including overheating of the ice making plates 10 can be prevented, not only increase in the recycling freezing time but also excessive increase in the lower level pressure to apply great load to the compressor 30 can be eliminated, besides drop in the freezing performance or breakdown of the compressor 30 can be prevented.

(2) In the Case Where the Ambient Temperature is Low

If the first temperature sensor 46 is detecting a temperature (low temperature) between the first temperature $T_1$ and the second temperature $T_2$ when the operation mode in the ice making machine is to be switched from the freezing operation to the ice releasing operation, the solenoid valve 44 is closed with a predetermined time lag after the hot gas valve 40 is let open, as shown in FIG. 3, to interrupt circulation Of the refrigerant through the freezing circuit 12 and to allow the hot gas to circulate through the hot gas circuit 42. More specifically, since the hot gas delivered from the compressor 30 during the ice releasing operation is entirely fed to the hot gas circuit 42 when the ambient temperature is low, no stagnation in the freezing circuit 12, as described above, occurs. Thus, not only drop of the ice releasing performance can be prevented, but also the time required for the ice releasing operation can be reduced, and besides the ice pieces can securely be released. Further, the refrigerant need not be introduced in a large amount beforehand taking stagnation of the refrigerant into account, so that the amount of the refrigerant to be sealed in the system can be minimized, leading to cost reduction. It should be noted that a predetermined time lag is secured using a timer and the like between the opening of the hot gas valve 40 and the closing of the solenoid valve 44 in the above embodiment, but the opening of the hot gas valve 40 and the closing of the solenoid valve 44 may be allowed to take place simultaneously. Then, the hot gas valve 40 is closed and the solenoid valve 44 is let open at the time point where the third temperature sensor 50 for detecting ice releasing completion detects the ice releasing completion temperature Te, and the operation mode is switched to the freezing operation. It should be noted that, since the open temperature To is lower than the ice releasing completion temperature To, the third temperature sensor 50 detects the open temperature To before it detects the ice releasing completion temperature Te, but the solenoid valve 44 is not allowed to let open in such case, as shown in FIG. 3.

(3) In the Case Where the Ambient Temperature is Very Low

If the first temperature sensor 46 is detecting a temperature (very low temperature) lower than the second temperature $T_2$ when the operation mode in the ice making machine is to be switched from the freezing operation to the ice releasing operation, the solenoid valve 44 is closed with a predetermined time lag after the hot gas valve 40 is let open, as shown in FIG. 4, to interrupt circulation of the refrigerant through the freezing circuit 12 and to allow the hot gas to circulate through the hot gas circuit 42. Thus, the hot gas delivered from the compressor 30 is entirely fed to the hot gas circuit 42, and the ice releasing can efficiently be carried out with no stagnation in the freezing circuit 12. It should be noted here again that the opening of the hot gas valve 40 and the closing of the solenoid valve 44 may be allowed to take place simultaneously.

When the open temperature To is detected by the second temperature sensor 48 after the ice releasing operation is started, the solenoid valve 44 is let open. Accordingly, the hot gas delivered from the compressor 30 is partly allowed to flow through the freezing circuit 12, and thus the amount of the hot gas to be fed to the hot gas circuit 42 decreases. Namely, the amount of the hot gas to be circulated decreases timely when some amount of ice pieces 16 are released from the ice making plates 10 to apply reduced load thereto, so that the third temperature sensor 50 does not detect the ice releasing completion temperature Te until the ice pieces 16 are entirely released. Thus, double-freezing can effectively be prevented.

Variations of the First Embodiment

Figure 5:
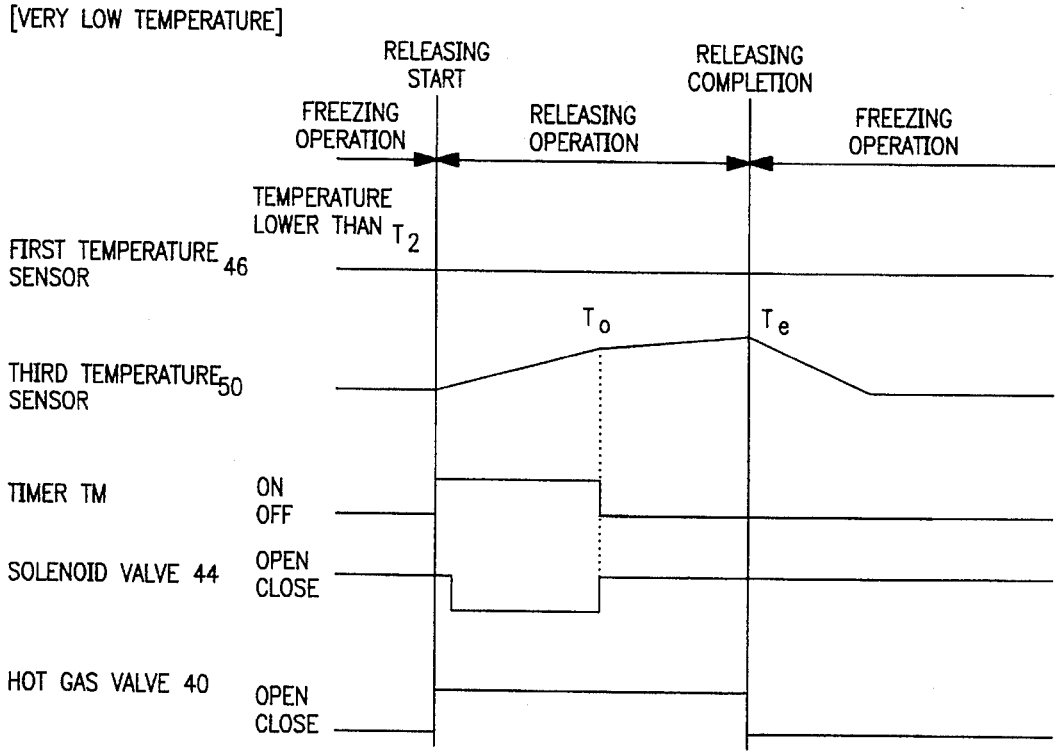
FIG. 5 is another chart showing the open/close timing of the solenoid valve and that of the hot gas valve in the refrigerant circuit according to the first embodiment at a very low temperature.

Although the first temperature sensor 46 is disposed on the refrigerant outlet side of the condenser 32 so as to carry out open/close control of the solenoid valve 44 in the first embodiment described above, the present invention is not limited to such embodiment. Since the condensation pressure in the condenser 32 changes depending on the change in the ambient temperature, for example, the condensation pressures at the normal ambient temperature, low ambient temperature and very low ambient temperature may be detected by the pressure sensor disposed on the refrigerant outlet side of the condenser 32 to control opening/closing of the solenoid valve 44. Alternatively, one common sensor can be allowed to play the roles of the second temperature sensor 48 and of the third temperature sensor 50. Incidentally, the first temperature sensor 46, the second temperature sensor 48 and the third temperature sensor 50 may be replaced by thermostats, respectively. Further, the second temperature sensor 48 for controlling the timing of opening the solenoid valve 44 at a very low temperature may be replaced by a timer TM, as shown in FIG. 5, so as to open the solenoid valve 44 with a predetermined time lag after the operation mode is switched to the ice releasing operation. Incidentally, when opening of the solenoid valve 44 is to be controlled using the timer TM, it can be achieved without being affected by the ambient temperature.

Second Embodiment

Figure 7:
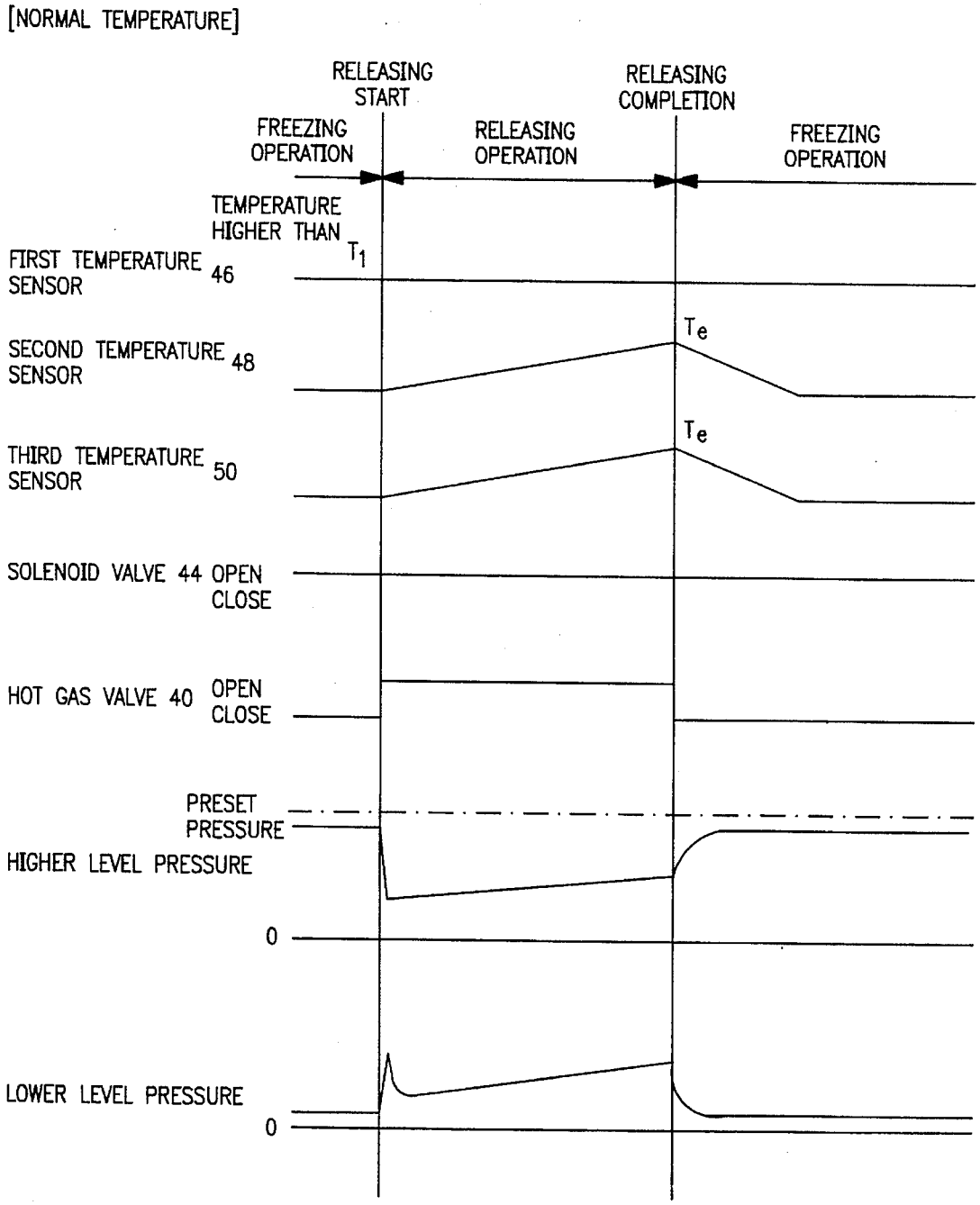
FIG. 7 is a chart showing the open/close timing of the solenoid valve and that of the hot gas valve in the refrigerant circuit according to the second embodiment, as well as, the higher level pressure and the lower level pressure at normal temperature.
Figure 8:
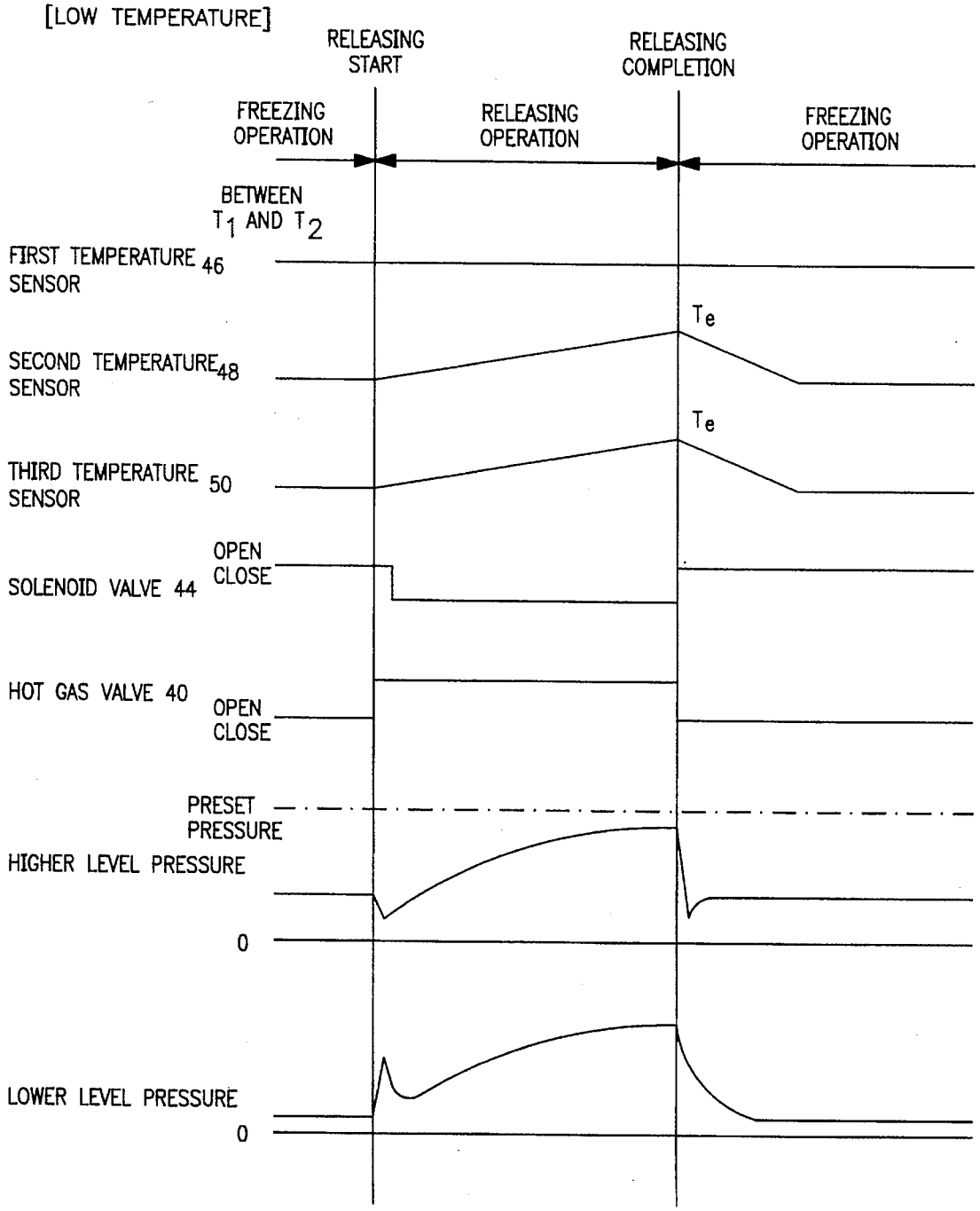
FIG. 8 is a chart showing the open/close timing of the solenoid valve and that of the hot gas valve in the refrigerant circuit according to the second embodiment, as well as, the higher level pressure and the lower level pressure at a low temperature.

It should be noted here that in the flow-down system ice making machine described above, releasing of ice is designed to be accelerated by allowing an ice releasing water to flow down along the rear surfaces (opposite to the ice making surfaces) of the ice making plates 10 in performing the ice releasing operation, Accordingly, the outlet side pressure (higher pressure) and the inlet side pressure (lower level pressure) in the compressor 30 during the ice releasing operation are increased under the predetermined conditions due to the temperature of the ice releasing water to apply load to the compressor 30 due to the thus increased higher level pressure and lower level pressure, causing not only drop in the performance but also liability of accidents including burning, damage, etc. For example, when the first temperature sensor 46 is detecting normal temperature in the state where the difference between the temperature to be detected by the first temperature sensor 46 and the temperature of the ice releasing water is small, as shown in FIG. 7, the solenoid valve 44 assumes an open posture, so that the increase in the higher level pressure and the lower level pressure will be small. Accordingly, there is absolutely no liability causing accidents in the compressor 30, Further, since the solenoid valve 44 is closed when the first temperature sensor 46 is detecting a low temperature, as shown in FIG. 8, the higher level pressure and the lower level pressure in the compressor 30 are elevated. However, these pressures in the compressor 30 are not increased to such levels as will cause accidents in the compressor 30.

Figure 9:
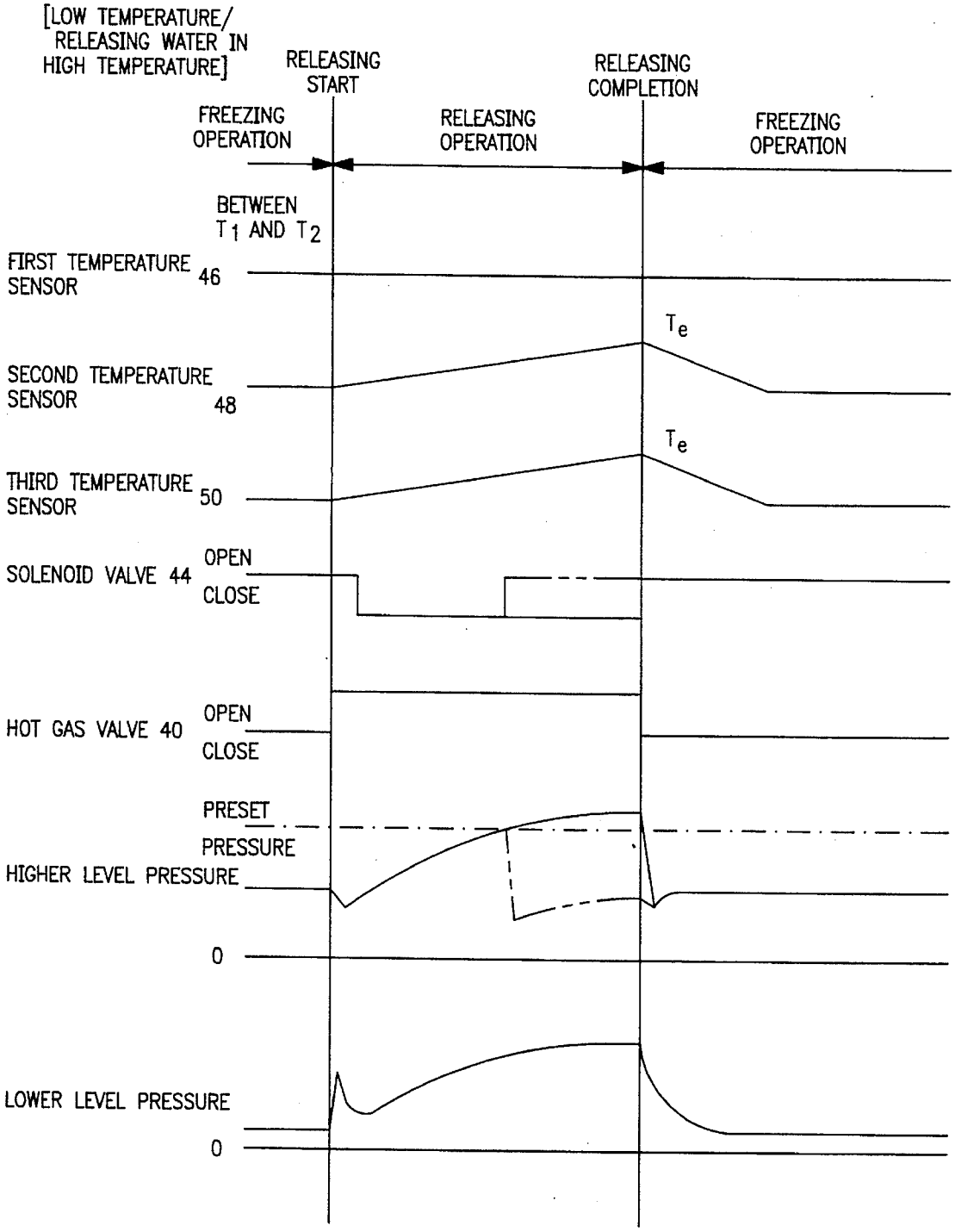
FIG. 9 is a chart showing the open/close timing of the solenoid valve and that of the hot gas valve in the refrigerant circuit according to the second embodiment and also those of when the temperature of the ice releasing water is high, as well as, the higher level pressure and the lower level pressure at a low temperature.

Therefore, when the difference between the temperature to be detected by the first temperature sensor 46 and the temperature of the ice releasing water is great, particularly when the temperature of the ice releasing water is at a high temperature (e.g. 25° C.) in the normal temperature region in the state where the first temperature sensor 46 is detecting a low temperature (e.g. the corresponding temperature at the ambient temperature of 10° C.) the lower level pressure increases, as shown in FIG. 9, and the higher level pressure can optionally be increased abnormally (as indicated by the solid lane in FIG. 9). If the higher level pressure exceeds the predetermined preset level, not only drop in the performance of the compressor 30 but also accidents including burning, damage, etc. will be caused.

In addition, in the ice making machine described above, it is preset that the powder supply is shut off when the ice pieces 16 are entirely released to drop from the ice making plates 10 by the ice releasing operation and that the ice releasing operation is to be resumed when the power supply is recovered. In such situation, since the lower level pressure and the higher level pressure are already elevated when the power supply is recovered in the ice releasing operation mode (see FIG. 8) even if the difference between the temperature to be detected by the first temperature sensor 46 and the temperature of the ice releasing water is small, there is a liability that the higher level pressure is abnormally elevated by resuming the ice releasing operation to cause drop in the performance off the compressor 30 or accidents including burning and damage thereof.

Figure 6:
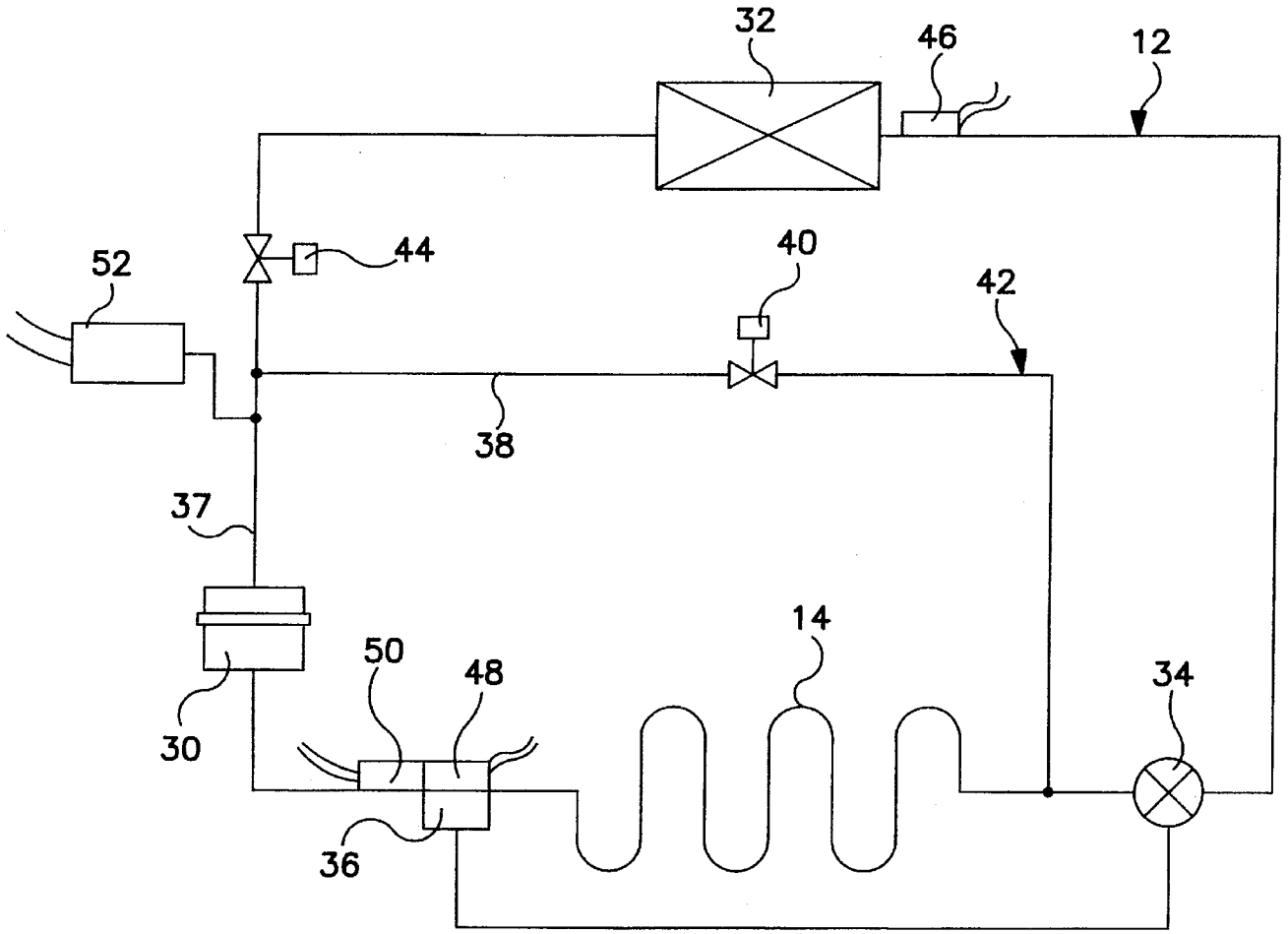
FIG. 6 shows schematically a constitution of the refrigerant circuit according to a second embodiment of the invention.

Therefore, in the refrigerant circuit according to the second embodiment shown in FIG. 6, a pressure switch 52 is additionally disposed between the compressor 30 and the solenoid valve 44 in the refrigerant circuit according to the first embodiment. Namely, the pressure switch 52 is interposed upstream, with respect to the flow of the refrigerant, than the junction of the pipe 37 on the outlet side of the compressor 30 and the pipe 38 of the hot gas circuit 42 (i.e. on the compressor (30) side). The pressure switch 52 is designed to carry out control of opening the solenoid valve 44, when it detects that the higher level pressure on the outlet side of the compressor 30 is exceeding a preset level in the state where the high-pressure and high-temperature refrigerant delivered from the compressor 30 is circulating through the hot gas circuit 42 by closing the solenoid valve after the operation mode of the ice making machine is switched to the ice releasing operation. It should be noted here that the pressure level of the pressure switch 52 is preset such that the efficient operation of the compressor 30 may not be hindered and that neither drop in the performance nor accidents such as burning and damage will be caused. Further, in the second embodiment, the solenoid valve 44 is controlled to be let open at an earlier time point of two cases where the pressure switch 52 detects that the pressure of the high-pressure and high-temperature refrigerant delivered from the compressor 30 is reaching the preset level or where the second temperature sensor 48 detects that the refrigerant temperature on the refrigerant outlet side of the evaporator 14 is reaching the preset open temperature To.

Function of the Second Embodiment

Next, function of the second embodiment will be described with respect to the case where the higher level pressure of the compressor 30 is abnormally elevated over the preset level during the ice releasing operation.

(In the case where the ice releasing water is at a high temperature under the state where the first temperature sensor is detecting a low temperature)

If the first temperature sensor 46 is detecting a temperature (low temperature) between the first temperature $T_1$ and the second temperature $T_2$ when the operation mode is to be switched from the freezing operation to the ice releasing operation in the ice making machine described above, the solenoid valve 44 is closed with a predetermined time lag after the hot gas valve 40 is let open, as shown in FIG. 9, to interrupt circulation of the refrigerant through the freezing circuit 12 and to allow the hot gas to circulate through the hot gas circuit 42. Thus, the ice making plates 10 attached to the evaporator 14 are heated to release adhesion of the ice pieces 16 formed on the ice making plates 10 and allow them to drop by their own weights. Namely, the hot gas delivered from the compressor 30 during the ice releasing operation is entirely fed to the hot gas circuit 42, so that no stagnation occurs in the freezing circuit 12 like in the first embodiment. Further, not only drop in the ice releasing performance can be prevented, but also the time required for the ice releasing operation can be reduced, and besides the ice pieces can securely be released. Incidentally, the opening of the hot gas valve 40 and the closing of the solenoid valve 44 may be allowed to take place simultaneously.

As described above, if the temperature of the ice releasing water to be allowed to flow along the rear surfaces of the ice releasing plates 10 during the ice releasing operation is high, the pressure on the refrigerant outlet side of the evaporator 14 is elevated, and thus the lower level pressure on the inlet side of the compressor 30 is increased. Concomitantly with such pressure rises, the higher level pressure on the outlet side of the compressor 30 is elevated as indicated by the solid line in FIG. 9, and the solenoid valve 44 is let open when the pressure switch 52 detects that the higher level pressure is reaching the preset level. Thus, the hot gas delivered from the compressor 30 partly flows into the freezing circuit 12, and the higher level pressure on the outlet side of the compressor 30 is lowered as indicated by the two dots-and-dashed line in FIG. 9. Consequently, drop in the performance of the compressor 30 due to the overload applied thereto and accidents such as burning and damage thereof can be prevented. Incidentally, the drop of the ice releasing performance may be adapted to be prevented by closing the solenoid valve 44 when the higher level pressure of the compressor 30 is lowered to some level due to the flow of the hot gas into the refrigerant circuit 12.

(In the Case Where the First Temperature Sensor is Detecting a Very Low Temperature)

Figure 10:
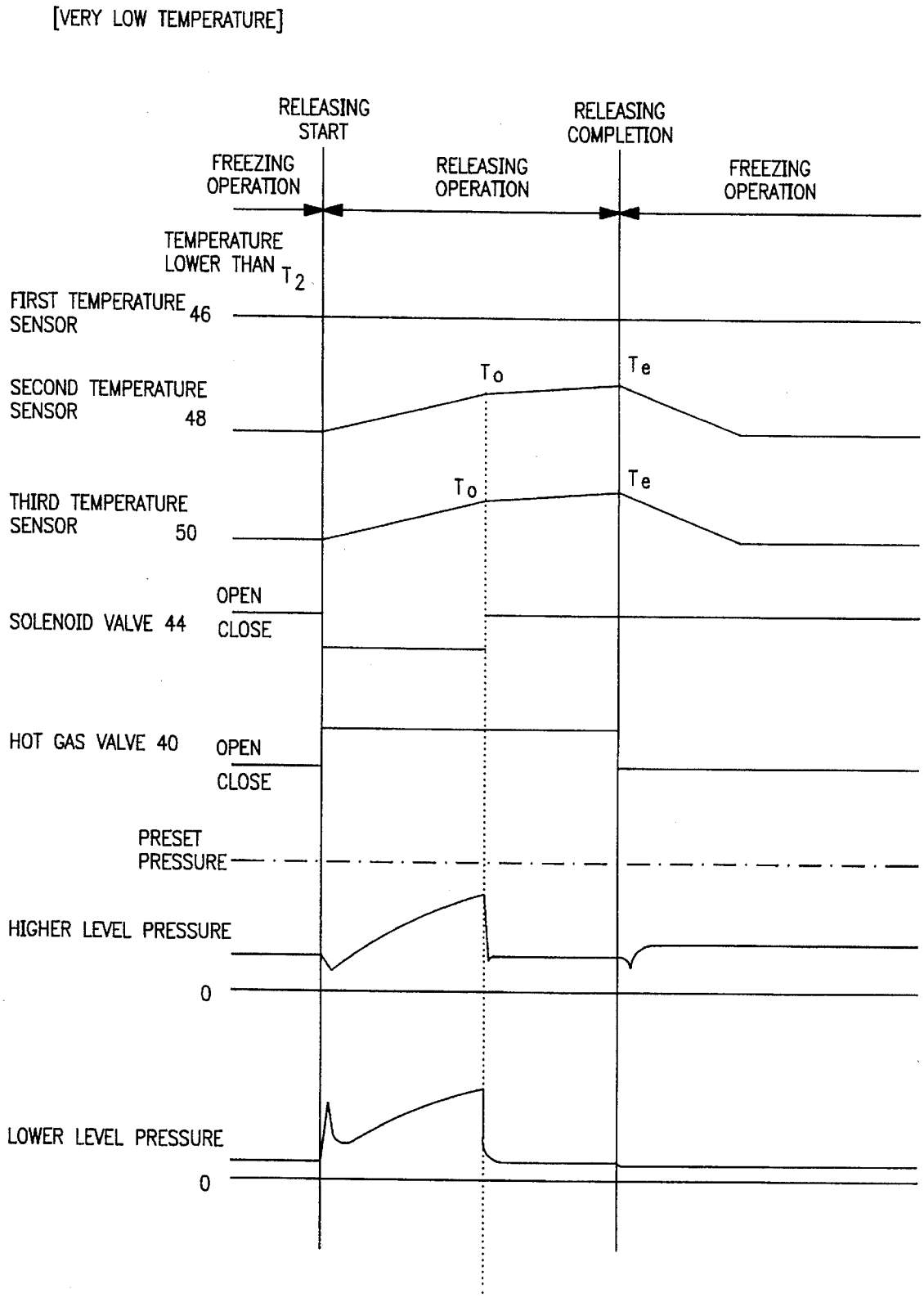
FIG. 10 is a chart showing the open/close timing of the solenoid valve and that of the hot gas valve in the refrigerant circuit according to the second embodiment, as well as, the higher level pressure and the lower level pressure at a very low temperature.

If the first temperature sensor 46 is detecting a very low temperature when the operation mode in the ice making machine is to be switched from the freezing operation to the ice releasing operation, the solenoid valve 44 is closed with a predetermined time lag after the hot gas valve 40 is opened, as shown in FIG. 10, to interrupt circulation of the refrigerant through the freezing circuit 12 and allow the hot gas to circulate through the hot gas circuit 42. Thus, the hot gas delivered from the compressor 30 is entirely fed to the hot gas circuit 42, so that the ice releasing operation can efficiently be carried out with no stagnation in the freezing circuit 12. It should be noted here again that the opening of the hot gas valve 40 and the closing of the solenoid valve 44 may be allowed to take place simultaneously.

The solenoid valve 44 is let open at an earlier time point of two cases where the open temperature To is detected by the second temperature sensor 48 and where the preset pressure level is detected by the pressure switch 52, after the ice releasing operation is started (in FIG. 10, the solenoid valve 44 is let open when the open temperature To is detected by the second temperature sensor 48). Therefore, the hot gas delivered from the compressor 30 partly flows into the freezing circuit 12, and thus the amount of the hot gas to be fed to the hot gas circuit 42 decreases. Namely, the higher level pressure of the compressor 30 is lowered, and thus drop in the performance of =he compressor 30, as well as, occurrence of damage etc. thereof can be prevented. Further, since the third temperature sensor 50 does not detect the ice releasing completion temperature Te until the ice pieces are entirely released from the ice making plates 10, as described above, double-freezing can effectively be prevented. It should be noted here that if the detection of the preset pressure level by the pressure switch 52 takes place earlier than the detection of the open temperature To by the second temperature sensor 48, the solenoid valve 44 is let open at the point of detection by the pressure switch 52, and thus not only drop in the performance of the compressor 30 and occurrence of damage etc. but also double-freezing can be prevented.

In addition, if the power supply is shut off when the ice pieces 16 are entirely released to drop from the ice making plates 10 during the ice releasing operation at a low temperature in the state where the temperature of the ice releasing water is not high, and then the power supply is recovered, the lower level pressure and the higher level pressure, which are already elevated, are further increased by resuming the ice releasing operation, as described above. In this case, since the solenoid valve 44 is let open to lower the higher level pressure at the point that the preset pressure level is detected by the pressure switch 52, possible accidents in the compressor 30 can be prevented.

Variations of the Second Embodiment

In the second embodiment, the solenoid valve 44 is controlled to be let open at the earlier time point of the two cases where the open temperature To is detected by the second temperature sensor 48 and where the preset pressure level is detected by the pressure switch 52, after the ice releasing operation is started in the state where the first temperature sensor 46 is detecting a very low temperature. However, this invention is not limited to such embodiment, but a timer TM, which starts counting from the time point that the ice releasing operation is started, may additionally be used. More specifically, the timer is preset to count a predetermined time period such that there may occur no drop in the performance of the compressor or accidents including burning and damage there due Co the abnormal elevation of the higher level pressure, as known through long experience, experiments, etc. After the ice releasing operation is started, the solenoid valve 44 is let open at the earliest time point of three cases where the open temperature To is detected by the second temperature, where the preset pressure is detected by the pressure switch 52 and where the timer TM finishes counting up of the preset time period. Thus, it can be prevented that the higher level pressure in the compressor 30 is abnormally increased to cause drop in the performance of the compressor 30 or damage etc. thereof, and besides double-freezing can effectively be prevented.

Incidentally, when the timer TM is to be employed, opening of the solenoid valve 44 can be con, rolled without being affected by the ambient temperature.

What is claimed is:

1. A refrigerant circuit for an ice making machine and the like, said circuit comprising:

a freezing circuit in which a high-pressure and high-temperature vaporized refrigerant obtained after compression in a compressor is fed via a solenoid valve to a condenser, the refrigerant condensed to be liquefied in said condenser is then fed to an expansion means, the refrigerant expanded to be vaporized through said expansion means is further fed to an evaporator, and the vaporized refrigerant heated through heat exchange with said evaporator is fed back to said compressor; and a hot gas circuit which bypasses said high-pressure and high-temperature vaporized refrigerant fed from said compressor to said evaporator via a hot gas valve so as to achieve ice releasing and the like at said evaporator;

said solenoid valve and said hot gas valve being designed to be let open and closed, respectively, during the freezing operation;

wherein said hot gas valve is designed to be let open with said solenoid valve still assuming an open posture, when the operation mode is switched to the ice releasing operation under the condition where the ambient temperature is higher than a predetermined level; and said hot gas valve and said solenoid valve are designed to be let open and closed, respectively, when the operation mode is switched to the ice releasing operation under the condition where the ambient temperature is lower than the predetermined level.

2. The refrigerant circuit for an ice making machine and the like according to claim 1, wherein said solenoid valve, which is closed when the operation mode is switched to the ice releasing operation, is designed to be let open before completion of the ice releasing operation.

3. A refrigerant circuit for an ice making machine and the like, said circuit comprising:

a freezing circuit in which a high-pressure and high-temperature vaporized refrigerant obtained after compression in a compressor is fed via a solenoid valve to a condenser, the refrigerant condensed to be liquefied in said condenser is then fed to an expansion means, the refrigerant expanded to be vaporized through said expansion means is further fed to an evaporator, and the vaporized refrigerant heated through heat exchange with said evaporator is fed back to said compressor; and a hot gas circuit which bypasses said high-pressure and high-temperature vaporized refrigerant fed from said compressor to said evaporator via a hot gas valve so as to achieve ice releasing and the like at said evaporator;

said solenoid valve and said hot gas valve being designed to be let open and closed, respectively, during the freezing operation and to be closed and let open, respectively, when the operation mode is switched to the ice releasing operation;

wherein said solenoid valve is designed to be let open before completion of the ice releasing operation.

4. A refrigerant Circuit for an ice making machine and the like, said circuit comprising:

a freezing circuit in which a high-pressure and high-temperature vaporized refrigerant obtained after compression in a compressor is fed via a solenoid valve to a condenser, the refrigerant condensed to be liquefied in said condenser is then fed to an expansion means, the refrigerant expanded to be vaporized through said expansion means is further fed to an evaporator, and the vaporized refrigerant heated through heat exchange with said evaporator is fed back to said compressor; and a hot gas circuit which bypasses said high-pressure and high-temperature vaporized refrigerant fed from said compressor to said evaporator via a hot gas valve so as to achieve ice releasing and the like at said evaporator;

said solenoid valve and said hot, gas valve being designed to be let open and closed, respectively, during the freezing operation, and to be closed and let open, respectively, when the operation mode is switched to the ice releasing operation;

wherein said solenoid valve is closed with a predetermined time lag after said hot gas valve is let open, when the freezing operation is switched to the ice releasing operation.

5. A refrigerant circuit for an ice making machine and the like, said circuit comprising:

a freezing circuit in which a high-pressure and high-temperature vaporized refrigerant obtained after compression in a compressor is fed via a solenoid valve to a condenser, the refrigerant condensed to be liquefied in said condenser is then fed to an expansion means, the refrigerant expanded to be vaporized through said expansion means is further fed to an evaporator, and the vaporized refrigerant heated through heat exchange with said evaporator is fed back to said compressor; and a hot gas circuit which bypasses said high-pressure and high-temperature vaporized refrigerant fed from said compressor to said evaporator via a hot gas valve so as to achieve ice releasing and the like at said evaporator;

wherein said hot gas valve is designed to be let open with said solenoid valve still assuming an open posture, when the operation mode is switched to the ice releasing operation under the condition where the ambient temperature is higher than a predetermined level;

said hot gas valve and said solenoid valve are designed to be let open and closed, respectively, when the operation mode is switched to the ice releasing operation under the skate where the ambient temperature is lower than the predetermined level; and said solenoid valve, which is closed when the operation mode is switched to the ice releasing operation, is designed to be let open, in the case where the ambient temperature is extremely lower than the predetermined temperature level, at the time point where a temperature sensing means, disposed adjacent to the refrigerant outlet side of said evaporator, detects that the refrigerant temperature on the refrigerant outlet side of said evaporator is reaching a predetermined level.

6. A refrigerant circuit for an ice making machine and the like, said circuit comprising:

a freezing circuit in which a high-pressure and high-temperature vaporized refrigerant obtained after compression in a compressor is fed via a solenoid valve to a condenser, the refrigerant condensed to be liquefied in said condenser is then fed to an expansion means, the refrigerant expanded to be vaporized through said expansion means is further fed to an evaporator, and the vaporized refrigerant heated through heat exchange with said evaporator is fed back to said compressor; and a hot gas circuit which bypasses said high-pressure and high-temperature vaporized refrigerant fed from said compressor to said evaporator via a hot gas valve so as to achieve ice releasing and the like at said evaporator;

wherein said hot gas valve is designed to be let open with said solenoid valve still assuming an open posture, when the operation mode is switched to the ice releasing operation under the condition where the ambient temperature is higher than a predetermined level:

said hot gas valve and said solenoid valve are designed to be let open and closed, respectively, when the operation mode is switched to the ice releasing operation under the state where the ambient temperature is lower than the predetermined level; and said solenoid valve, which is closed when the operation mode is switched to the ice releasing operation, is designed to be let open at the time point where a timer, which starts counting when the operation mode is switched to the ice releasing operation, detects a preset time period.

7. The refrigerant circuit for an ice making machine and the like according to any of claims 1, 3, 4, 5 and 6, wherein said solenoid valve, which is closed when the operation mode is switched to the ice releasing operation, is designed to be let open at the time point where a pressure detecting means disposed between said compressor and said solenoid valve detects that the pressure of the high-pressure and high-temperature vaporized refrigerant delivered from said compressor is reaching a predetermined level.

8. The refrigerant circuit for an ice making machine and the like according to any of claims 1, 5 and 6, wherein a temperature sensing means is disposed on the refrigerant outlet side of said condenser, and said hot gas valve is designed to be let open with said solenoid valve still assuming an open posture when the operation mode is switched to the ice releasing operation under the condition where said temperature sensing means is detecting a temperature higher than a preset level; whereas said hot gas valve and said solenoid valve are designed to be let open and closed, respectively, when the operation mode is switched to the ice releasing operation under the condition where said temperature sensing means is detecting a temperature lower than the preset level.

* * * * *